US007351035B2

(12) United States Patent
Deschamps et al.

(10) Patent No.: US 7,351,035 B2
(45) Date of Patent: Apr. 1, 2008

(54) HOLLOW ROTOR BLADE FOR THE TURBINE OF A GAS TURBINE ENGINE, THE BLADE BEING FITTED WITH A "BATHTUB"

(75) Inventors: Pascal Deschamps, Bagneux (FR); Chantal Gisele Giot, Combs la Ville (FR); Thomas Potier, Paris (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 11/382,415

(22) Filed: May 9, 2006

(65) Prior Publication Data

US 2006/0257257 A1 Nov. 16, 2006

(30) Foreign Application Priority Data

May 13, 2005 (FR) ..... 05 04811

(51) Int. Cl.
*F01D 5/20* (2006.01)

(52) U.S. Cl. ..... 416/92; 416/97 R

(58) Field of Classification Search ..... 416/90 R, 416/92, 96 R, 97 R, 224; 415/115, 173.4, 415/173.5

See application file for complete search history.

(56) References Cited

U.S. PATENT DOCUMENTS

| | | | | |
|---|---|---|---|---|
| 4,424,001 | A * | 1/1984 | North et al. | 416/92 |
| 6,494,678 | B1 * | 12/2002 | Bunker | 416/97 R |
| 6,527,514 | B2 * | 3/2003 | Roeloffs | 416/97 R |
| 6,602,052 | B2 * | 8/2003 | Liang | 416/97 R |
| 6,672,829 | B1 * | 1/2004 | Cherry et al. | 415/115 |
| 6,790,005 | B2 * | 9/2004 | Lee et al. | 416/97 R |
| 2002/0182074 | A1 | 12/2002 | Bunker | |

* cited by examiner

*Primary Examiner*—Edward K. Look
*Assistant Examiner*—Nathan Wiehe
(74) *Attorney, Agent, or Firm*—Oblon, Spivak, McClelland, Maier & Neustadt, P.C.

(57) ABSTRACT

A hollow blade has an internal cooling passage, an open cavity situated at the free end of the blade and defined by an end wall extending over the entire end of the blade and by a rim. The blade includes cooling channels connecting the internal cooling passage and the outside face of the pressure side wall. The pressure side wall presents a projecting end portion whose outside face is inclined relative to the outside face of the pressure side wall. The cooling channels are disposed in the end portion, being parallel to the outside face of the end portion so that they open out into the tip of the end portion towards the free end of the blade.

8 Claims, 6 Drawing Sheets

HOLLOW ROTOR BLADE FOR THE TURBINE OF A GAS TURBINE ENGINE, THE BLADE BEING FITTED WITH A "BATHTUB"

The invention relates to a hollow rotor blade for the turbine of a gas turbine engine, in particular for a turbine of the high pressure type.

More precisely, the present invention relates to making a hollow blade of the type that includes an internal cooling passage, an open cavity situated at the free end of the blade and defined by an end wall extending over the entire end of the blade and by a rim extending between the leading edge and the trailing edge along at least the suction side wall, and cooling channels connected said internal cooling passage and the outside face of the pressure side wall, said cooling channels being inclined relative to the pressure side wall.

BACKGROUND OF THE INVENTION

Cooling channels of this type are intended for cooling the free end of the blade since they enable a jet of cooling air to be delivered from the internal cooling passage towards the end of the blade at the top end of the outside face of the pressure side wall. This jet of air serves to "pump heat", i.e. to reduce the temperature of the metal by absorbing heat from the core of the metal wall, and it also creates a film of cooling air that protects the ends of the blades on the pressure side.

Because of the high working speeds at the ends of such blades, and because of the temperatures to which the blades are subjected in operation, it is necessary to cool them so that their temperature remains lower than the temperature of the gas in which they work.

That is why it is conventional for blades to be hollow so as to enable them to be cooled by the air present in an internal cooling passage.

It is also known to provide the end of the blade with an open cavity that is also referred to as a "bathtub": this shape for the end of a blade limits the areas facing each other between the end of the blade and the corresponding annular surface of the turbine casing, so as to protect the body of the blade against the damage caused by the blade possibly coming into contact with the annular segment.

Patent documents U.S. Pat. No. 6,231,307, EP 0 816 636, and FR 2 858 650 present such a hollow blade that it is also provided with cooling passages connecting the internal cooling passage with the outside face of the rim of the cavity beside the pressure side wall, these cooling channels opening out at their outlets in the outside face of the pressure side wall towards the tip of said rim.

Those cooling channels situated beside the pressure side wall thus enable a jet of air to exit from the internal cooling passage that is cooler than the air surrounding the pressure side wall with said jet of air forming a film of cooling air that is localized over the outside face of the pressure side wall, and that is sucked towards the suction side wall, passing over the end of the blade.

In patent document U.S. Pat. No. 6,231,307, those inclined cooling channels connect the internal cooling passage with the outside face of the rim of the cavity at the pressure side wall by being disposed (see FIG. 2 of that document) in such a manner as to pass through the end wall of the cavity and through the rim of the cavity level with the pressure side wall, passing via said cavity.

That solution thus requires a large thickness of material, whether for the end wall of the cavity or for the cavity rim, in order to avoid degrading the high temperature strength performance at the tip of the blade. In addition, that solution puts a very severe limit on the flow of cooling air that reaches the tip of the rim, since the major fraction of the flow leaves the internal cooling passage via the first segments of the cooling channels and penetrates directly into the cavity without reaching the outside face of the pressure side wall.

The solution of document EP 0 816 636, as can be seen in FIG. 5 of that document, consists in placing those cooling channels in such a manner that they pass through the pressure side wall opening out into the outside face of said pressure side wall level with the base of a cavity rim.

That solution likewise requires a large thickness of material, whether for the end wall of the cavity or for the cavity rim, in order to avoid degrading the high temperature strength performance at the tip of the blade.

Document FR 2 858 650 proposes a solution (see FIG. 5) that consists in providing reinforcement of material between the rim and the end wall of the cavity along at least a fraction of the pressure side wall, whereby said rim is enlarged at its base adjacent to said end wall so that the cooling channels open out close to the tip of the rim without degrading the high temperature strength of the blade. In that way, by having reinforcing material, the cooling channels can thus open out closer to the tip of the rim without changing the distance between said cooling channels and the end wall of the cavity.

However, given the ever-increasing operating temperatures of turbines, those solutions no longer make it possible to provide a hollow blade with the end of the blade being cooled in satisfactory manner.

In order to maintain sufficient high temperature strength around the cooling channels, making use of large wall thicknesses leads to the moving wheel(s) of the turbine being made much heavier. Consequently, since the thicknesses of material are large, the more the temperature rises because cooling is not so fast, the more these large thicknesses of material prevent sufficient cooling at the tip of the blade to enable the turbine to operate at the desired higher temperatures.

It should be observed that if cooling is insufficient at the end of the blade, local burning can take place that can lead to metal being lost, thereby increasing clearances, and thus harming the aerodynamic efficiency of the turbine. Likewise, when the rim of the cavity sees its temperature increase excessively, there is observed to be a risk of burning with damage to the metal wall.

OBJECTS AND SUMMARY OF THE INVENTION

The present invention seeks to solve the above-specified problems.

Consequently, an object of the present invention is to provide a hollow rotor blade for the turbine of a gas turbine engine, of the above-specified type, that enables the end of the blade to be cooled in a manner that is sufficient so as to increase its reliability without reducing the aerodynamic and high temperature strength performance of the blade.

To this end, according to the present invention, the pressure side wall presents a projecting end portion whose outside face is inclined relative to the outside face of the pressure side wall, the end wall being connected to the pressure side wall at the location of said end portion, said cooling channels being disposed in said end portion, being parallel to the outside face of said end portion so that they open out into the tip of said end portion towards the free end of the blade, and the tip of the end portion lies in the same face (or plane) as the outside face of the end wall, such that said cooling channels open out into the pressure side wall in front of the cavity, the inside face of said rim of the suction side wall is inclined, enlarging said rim towards the free end of the blade.

In this manner, it can be understood that the presence of the end portion projecting relative to the pressure side wall, with the cooling channels opening out directly into the tip of said end portion, enables the cooling air to be sent directly to the free end of the blade, immediately upstream from the open cavity or "bathtub".

This solution also presents the additional advantage of not only bringing the outlets of the cooling channels to the free end of the blade, but also making it possible to provide a pressure side surface for the blade that is made concave at the tip of the blade due to the fact that the outside face of the end portion is inclined.

This particular shape is preferably present along the entire profile from the leading edge to the trailing edge. It makes it possible to prevent a flow through the clearance at the tip of the blade. The inclination of the wall towards the pressure side at the tip of the blade leads to strong separation of the boundary layer at the tip of the blade. As a result, the flow section as "seen" by the flow between the tip of the blade and the case is made smaller by the separation of the boundary layer being increased in size: this reduces the flow that is "lost" into the gap between the tip of the blade and the casing.

Thus, this projecting end portion with its inclined outside face makes it possible to obtain improvements that are not only thermal but also that are hydraulic at the tip of the blade, as well as mechanically strengthening the tip of the blade at the location of the open cavity or "bathtub".

Thus, by means of a solution of the present invention, it is possible to increase the overall performance of the turbine.

It should be observed that various orientations can be envisaged for the end wall.

In a first variant, the outside face of the end wall is substantially perpendicular to the pressure side wall and to the suction side wall, i.e. the outside face of the end wall presents an orientation that is parallel to the axis of the blade, which axis can be referred to as being horizontal.

In a second variant, the outside face of the end wall is inclined relative to the pressure side wall and to the suction side wall, forming an acute angle with the rim of the cavity extending the suction side wall. In this case, the outside face of the end wall slopes away from the free end of the blade—or towards the axis of the blade—starting from the pressure side wall and going towards the suction side wall.

BRIEF DESCRIPTION OF THE DRAWINGS

Other advantages and characteristics of the invention appear on reading the following description made by way of example and given with reference to the accompanying drawings, in which.

MORE DETAILED DESCRIPTION

Figure 1:
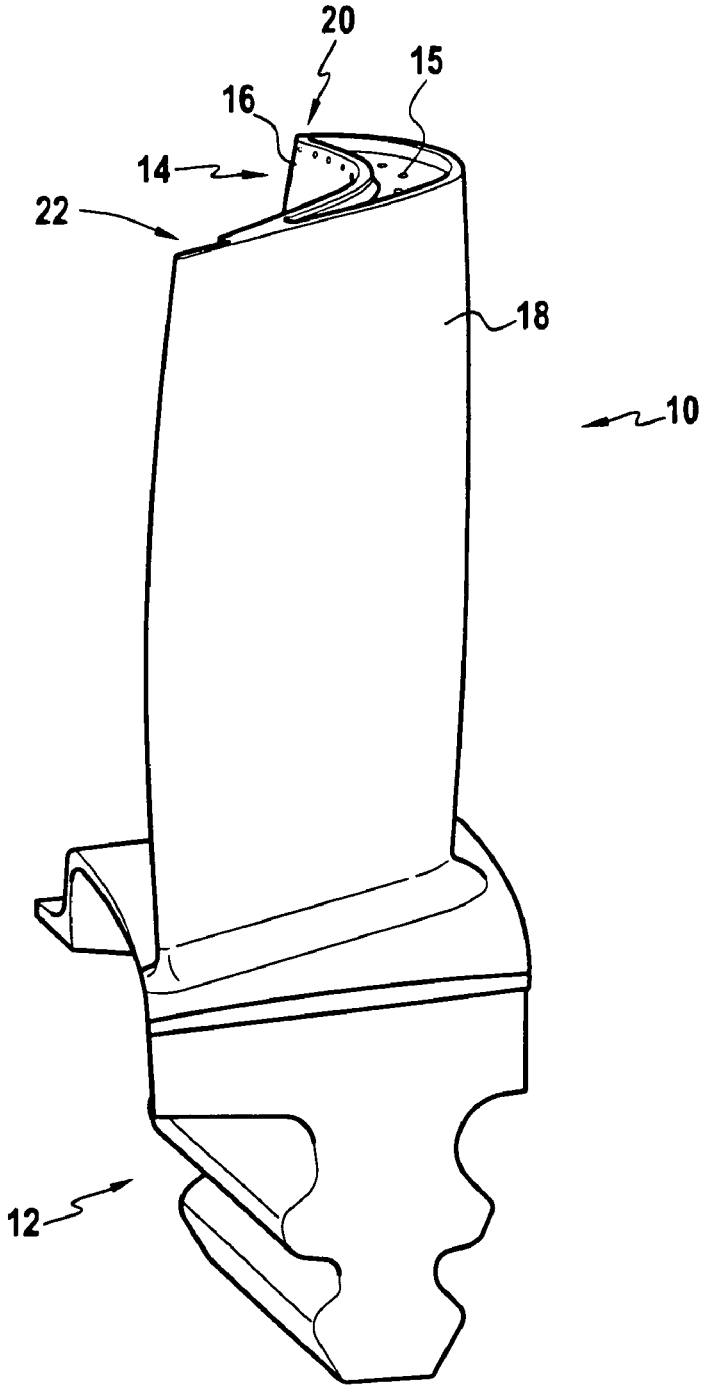
FIG.1 PRIOR ART
FIG. 1 is a perspective view of a conventional hollow rotor blade for a gas turbine.

FIG. 1 is a perspective view showing an example of a conventional hollow rotor blade 10 for a gas turbine. Cooling air (not shown) flows inside the blade from the bottom of the root 12 of the blade in the radial direction (vertically) towards the free end 14 of the blade (at the top of FIG. 1), and then cooling air escapes via an outlet to join the main gas stream.

In particular, as can be seen in FIGS. 2 to 5, this cooling air flows in an internal cooling passage 24 situated inside the blade 10 and terminating at the free end 14 of the blade via through holes 15.

The body of the blade is shaped so as to define a pressure side wall 16 (to the left in all of the figures) and a suction side wall 18 (to the right in all of the figures). The pressure side wall 16 is generally concave in shape and presents the first face to the hot gas stream, i.e. to the pressure side of the gas, while the suction side wall 18 is convex and presents itself to the hot gas stream subsequently, i.e. to the suction side of the gas.

The pressure and suction side walls 16 and 18 meet at the location of the leading edge 20 and at the location of the trailing edge 22, which edges extend radially between the free end 14 of the blade and the top of the blade root 12.

Figure 2:
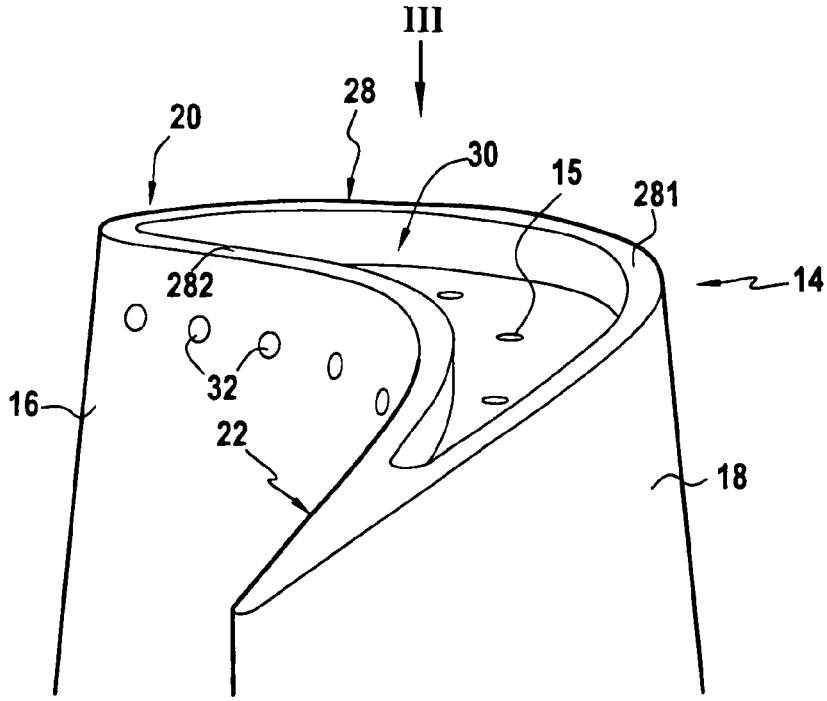
FIG.2 PRIOR ART
FIG. 2 is a perspective view on a larger scale of the free end of the FIG. 1 blade.
Figure 3:
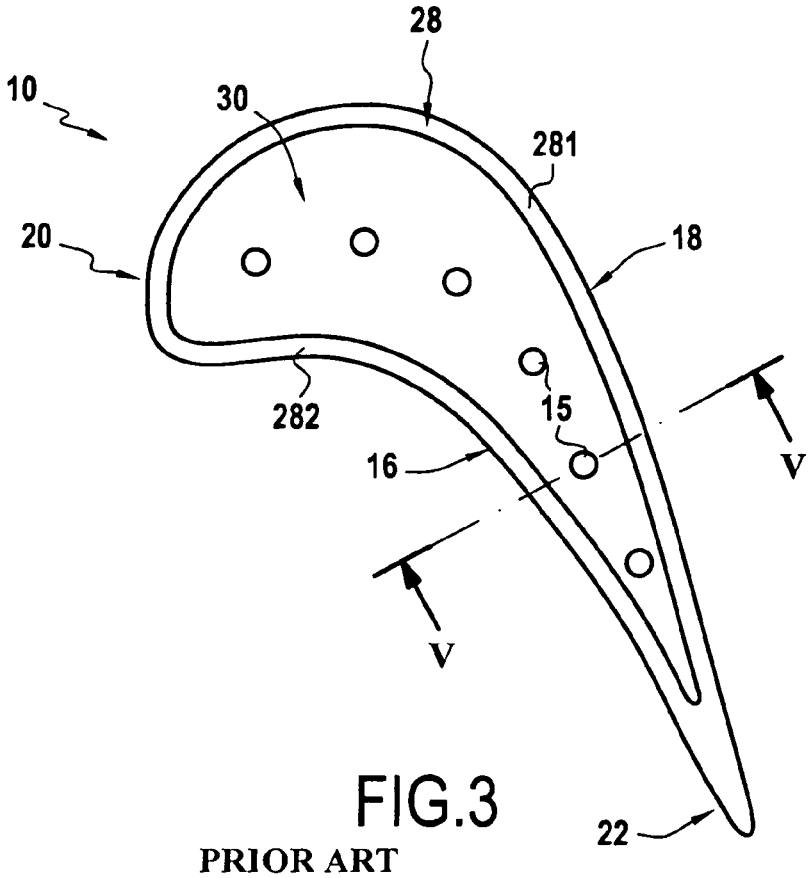
FIG.3 PRIOR ART
FIG. 3 is a simplified view looking along direction III of FIG. 2, showing the free end of the blade.
Figure 4:
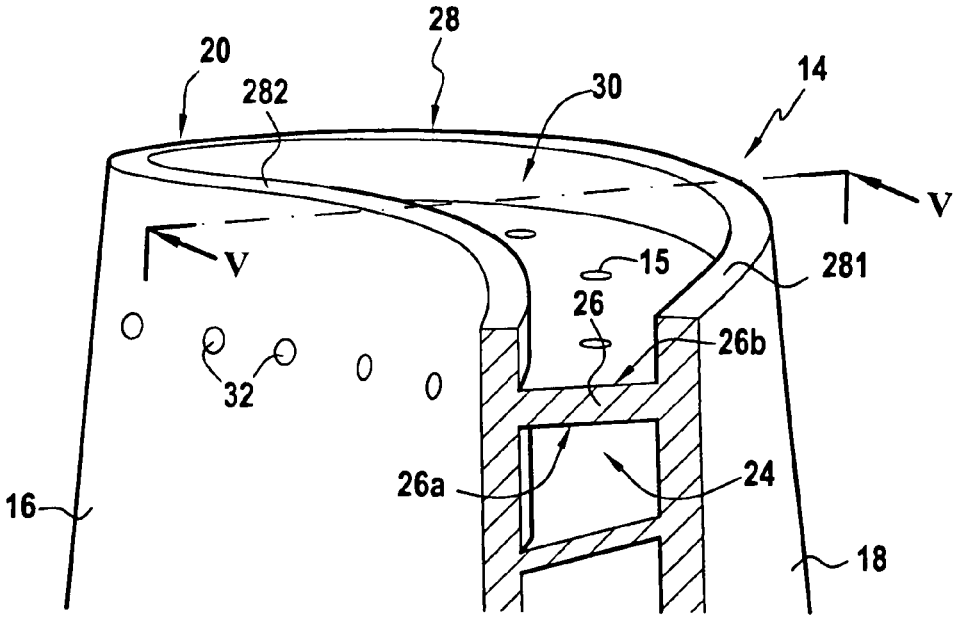
FIG.4 PRIOR ART
FIG. 4 is a view analogous to that of FIG. 2, after the trailing edge of the blade has been removed by a longitudinal section.
Figure 5:
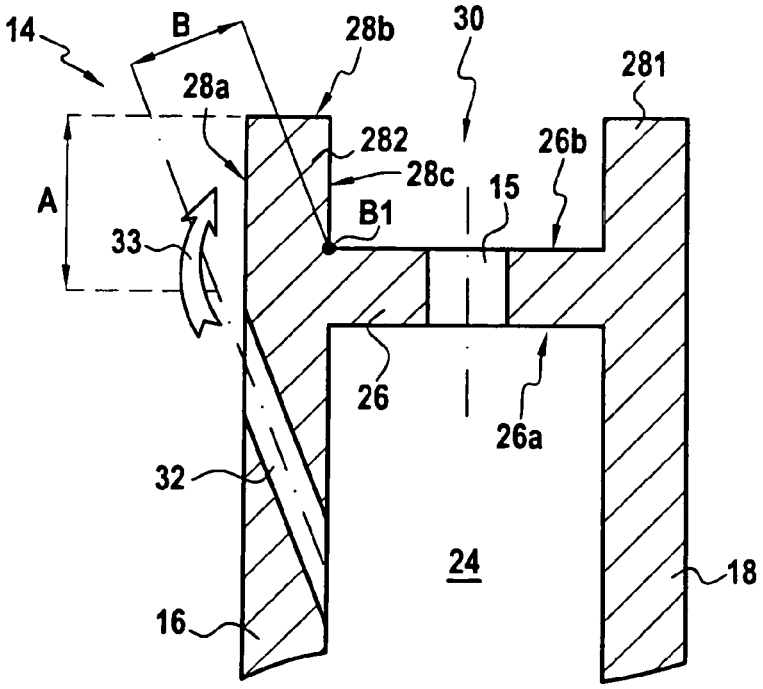
FIG.5 PRIOR ART
FIG. 5 is a longitudinal section view on V-V of FIG. 3 or FIG. 4.
Figure 6:
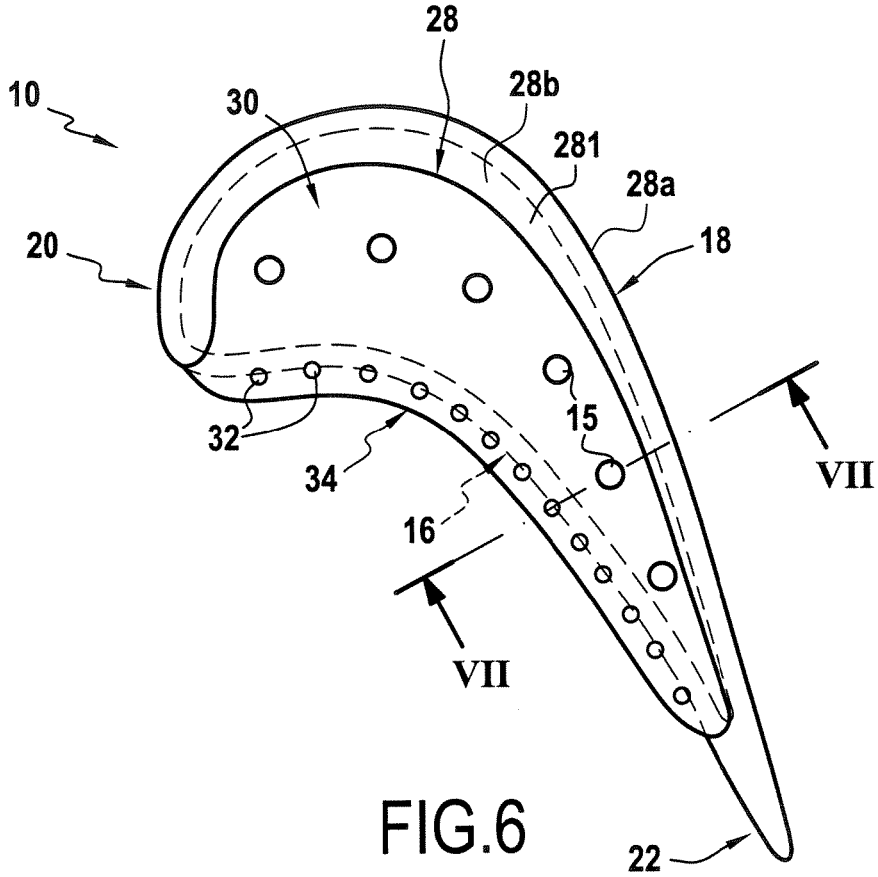
FIGS. 6 and 7 are views analogous to FIGS. 3 and 5 respectively, showing the adaptations made to the blade in the present invention.

As can be seen in the enlarged views of FIGS. 2, 4, and 5, at the free end 14 of the blade, the internal cooling passage 24 is defined by the inside face **26*a* of an end wall 26 that extends over the entire free end 14 of the blade, between the pressure side wall 16 and the suction side wall 18, from the leading edge 20 to the trailing edge 22**.

Through holes 15 are distributed in such a manner as to optimize cooling, from the leading edge 20 to the trailing edge 22, passing radially through the entire thickness of the end wall 26.

At the free end 14 of the blade, the pressure side and suction side walls 16 and 18 form the rim 28 of a "bathtub" or cavity 30 that is open facing away from the internal cooling passage 24, i.e. radially outwards (upwards in all of the figures).

This rim 28 is formed by a suction side rim 281 and a pressure side rim 282 respectively extending the suction side wall 18 and the pressure side wall 16 radially outwards (towards the top in all the figures), beyond the end wall 26 to the free end 14 of the blade.

As can be seen in FIGS. 2, 4, and 5, this open cavity 30 is thus defined laterally by the inside face of the rim 28 and in its bottom portion by the outside face **26*b* of the end wall 26**.

The rim 28 thus forms a thin wall along the profile of the blade and protects the free end 14 of the blade 10 from coming into contact with the corresponding annular surface of the turbine casing.

As can be seen more precisely in the section view of FIG. 5, inclined cooling channels 32 pass through the pressure side wall 16 to connect the internal cooling passage 24 to the outside face of the pressure side wall 16, beneath the outside face 28*a* of the pressure side rim 282.

These cooling channels 32 are inclined so as to open out towards the tip 28*b* of the pressure side rim 282 so as to cool this rim 28*b* as much as possible along the pressure side wall 16, or more precisely along the outside face 28*a* of the pressure side rim 282.

As can be seen in FIG. 5, arrow 33 at the outlet of the cooling channels 32 represents a jet of air that goes towards the tip 28*b* of the pressure side rim 282 along the pressure side wall 16.

In known blades, as shown more precisely in FIG. 5, in order to ensure sufficient strength at high temperature for the free end of the blade 14, it is appropriate to leave a sufficient distance B between the outlets from the cooling channels 32 (the reference point being the axis of each channel) and the intersection (B1) between the inside face 28*c* of the pressure side rim 282 level with the pressure side wall 16 and the outside face 26*b* of the end wall 26 facing towards said cavity 30.

This situation, which results from a mechanical construction requirement, means that the distance A as measured between the outlets from the cooling channels 32 (the reference point being the axis of each channel) and the tip 28*b* of the rim 28 beside the pressure side wall, which is much greater than the above-mentioned distance B, is too large for the tip 28*a* to be cooled sufficiently strongly.

In order to mitigate that drawback, the pressure side wall 16 presents a projecting end portion 34 whose outside face is inclined relative to the outside face of the pressure side wall 16, the cooling channels 32 extending through this end portion 34.

In addition, according to the present invention, provision is made for the following:

- the tip of the end portion 34 lies in the same plane as the outside face of the end wall 26, such that said cooling channels 32 open out from the pressure side wall 16 in front of the cavity 30: this means that in accordance with the invention, since the projecting end portion 34 terminates at the same height as the outside face 26*b* of the end wall 26, the end of the blade 14 and the pressure side wall 16 do not include the pressure side rim 282; and
- the inside face 28*c* of said rim 281 of the suction side wall 18 is inclined so as to enlarge said rim 281 towards the free end 14 of the blade 10.

Figure 7:
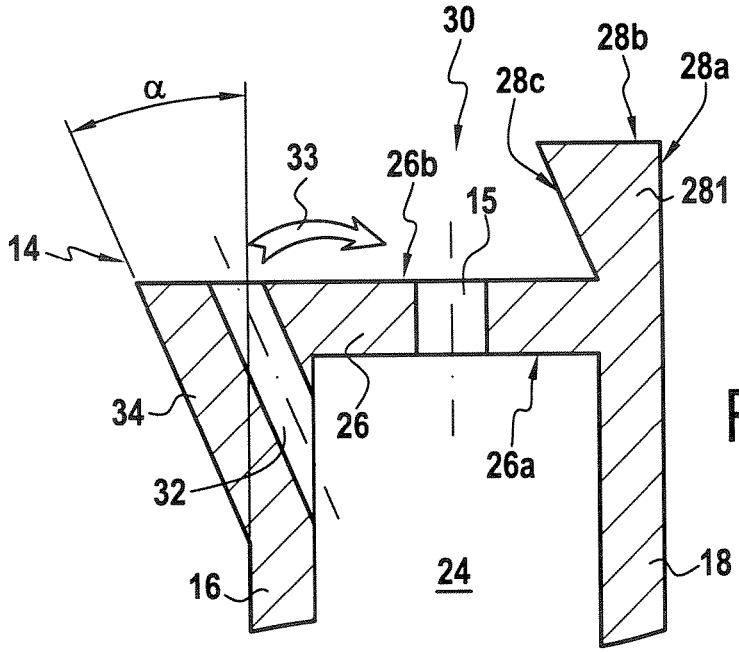
Figure 8:
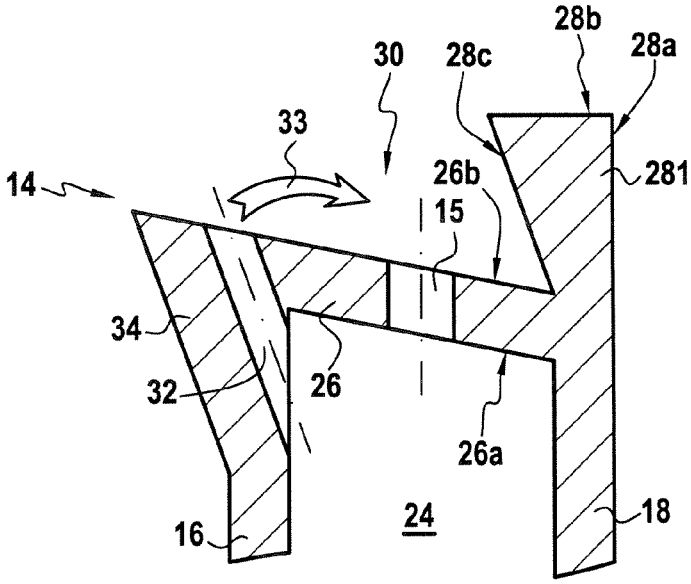
FIG. 8 is a view analogous to FIG. 7 showing a version that is slightly different.

As can be seen in particular in FIGS. 7 and 8 the pressure side wall 16 projects outwards at the location of the end portion 34 situated at the free end 14 of the blade, such that the outside face of the end portion 34 is inclined and forms an acute angle $\alpha$ with the radial direction (vertical in FIGS. 7 and 8) of the outside face of the remainder of the pressure side wall 16, this angle $\alpha$ preferably lying in the range 0 to 45°, and in particular in the range 10° to 35°, and advantageously in the range 15° to 30°, and is preferably about 30°.

In this way, if the outside face of the pressure side wall 16 is followed from the root of the blade 12 towards the free end 14, the general direction of the pressure side wall 16 is radial (vertical), and then at the end portion 34 it forms a wide open concave end outline at an obtuse angle that is complementary to the acute angle $\alpha$.

This end portion 34 extends over a height such that the end wall 26 is connected to the pressure side wall 16 at the location of the end portion 34, with the tips of the end wall 26 and of the end portion 34 being in alignment. Thus, the base of the end portion 34 remote from the free end 14 is at a location situated radially between the inside face 26*a* of the end wall 26 and 75% of the height of the pressure side wall 16 going from the root 12 of the blade.

In addition, the cooling channels 32 are always inclined, but in this configuration according to the invention, since they pass through the end portion 34, they can open out directly into the bottom of the bathtub-forming open cavity 30 by passing through the full height of the end portion 34.

In this way, the cooling air passing through the channels 32 emerges (arrow 33) into the open cavity 30, such that a flow of cooler air remains continuously present at the tip of the blade, level with the free end 14, upstream from the open cavity 30, thereby contributing to improving the high temperature strength of the blade.

In addition, the presence of the cooling channels 32 inside the end portion 34 makes it possible to cool these zones of material by thermal conduction.

The variant shown in FIG. 8 differs from that of FIG. 7 solely by the fact that the end wall 26 is no longer orthogonal (horizontal) relative to the pressure side and suction side walls 16 and 18, but instead the end wall 26 is inclined. More precisely, the outside face 26*b* of the end wall 26 of the open cavity 30 forms an acute angle (i.e. an angle of less than 90°) relative to the outside face 28*a* of the suction side rim 281, or indeed the suction side wall 18.

In this way, the outside face 26*b* goes away from the free end 14 of the blade from the pressure side wall 16 towards the suction side wall 18.

This configuration allows the cooling air coming from the channels 32 (arrow 33) to be directed towards the inside of the open cavity 30 as far as the end wall 26, being combined with the cooling air coming from the holes 15.

In the embodiment of FIG. 7, the tip of the end portion 34 is orthogonal to the pressure side and suction side walls 16 and 18, in a direction parallel to the tip of the suction side rim 281.

The suction side rim 281 also forms a wall situated radially in line with the suction side wall 18, its outside face 28*a* being vertical (FIGS. 7 and 8).

In contrast, as can be seen in FIGS. 7 and 8, the suction side rim 281 presents an inside face 28*c* facing towards the pressure side wall 16 and facing the open cavity 30, this wall not being vertical but extending in inclined manner, forming an acute angle (i.e. an angle of less than 90°) with the outside face 26*b* of the end wall 26, or with the suction side wall.

Under such circumstances, the suction side rim 281 is thus wider at its tip 28*b*.

This inclination of the inside face 28*c* of the suction side rim 281 towards the pressure side wall 16 makes it possible to improve the limitation on the rate of flow passing into the clearance. This flow rate limitation is in addition to that generated by the end portion 34 projecting relative to the pressure side wall 16.

Furthermore, since there is no pressure side rim (see 282 in FIG. 11) in the embodiments shown in FIGS. 7 and 8, this inclination of the inside face 28*c* of the suction side rim 281 towards to the pressure side wall 16 makes it possible to limit the flow rate without having any projection outside the shape defined by aerodynamic calculations.

It should be observed that the embodiments shown and described above with reference to FIGS. 7 and 8 can be combined on a single blade with other shapes.

Figure 9:
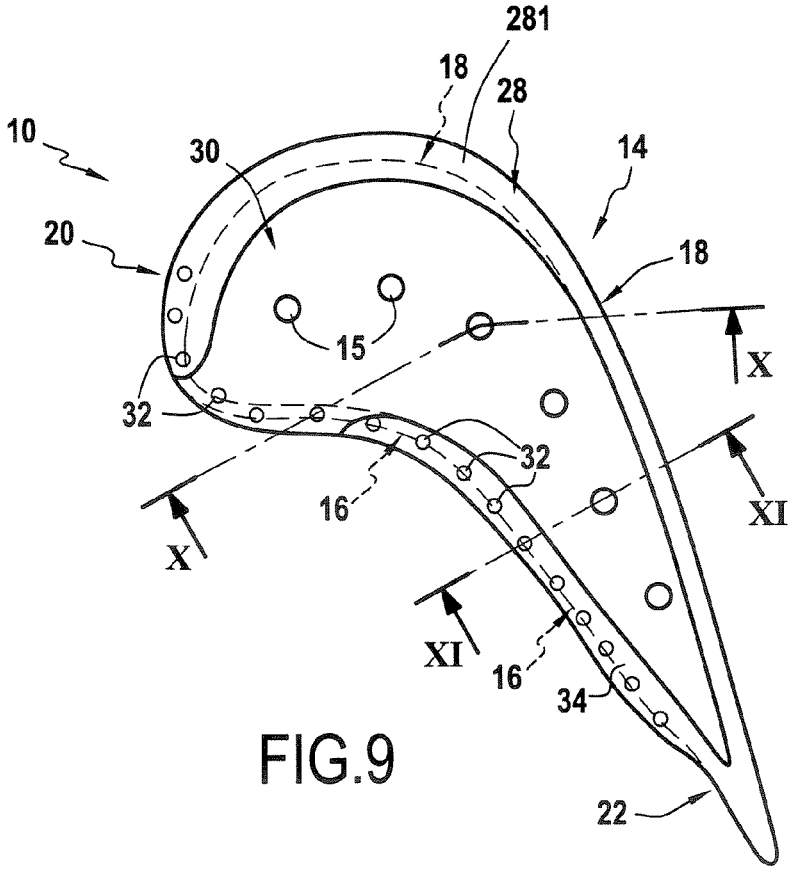
FIG. 9 is a simplified end view similar to that of FIG. 3 for a blade combining different shapes, including one in accordance with the present invention, for the free end of the blade.
Figure 11:
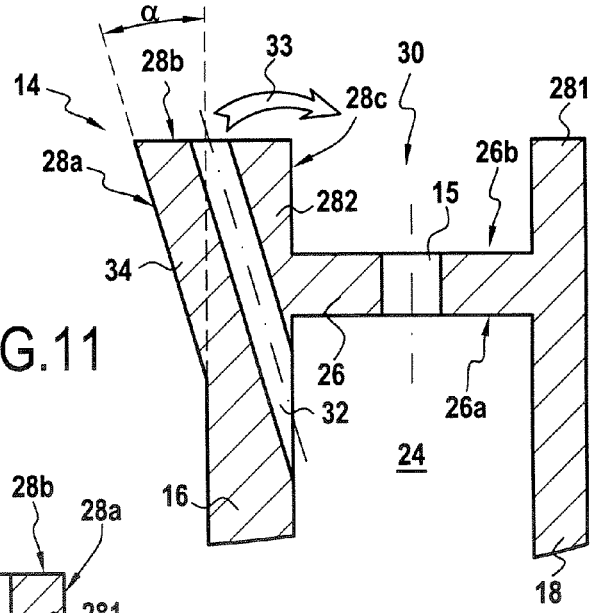

Thus, by way of example, FIG. 9 shows the free end 14 of a blade 10 that presents a plurality of configurations between its leading edge 20 and its trailing edge 22:

at the front of the blade, downstream from the leading edge 20, there can be found the configuration of FIG. 7 with an end portion 34 projecting beside the pressure side wall 16 without a pressure side rim and with a suction side rim 281 that is enlarged at its tip 28*b*; and towards the rear of the blade, upstream from the trailing edge 22, there is a disposition as shown in FIG. 11 with, beside the pressure side wall 16, a projecting end portion 34 having a pressure side rim 282 that is enlarged at its tip 28*b* (in fact there is an outside face 28*a* of the pressure side rim 282 that is inclined and an inside face 28*b* of the pressure side rim 282 that is vertical), and beside the suction side wall 18, a suction side rim 281 that is not enlarged at its tip, the tips of the pressure side and suction side rims 282 and 281 being perpendicular to the vertical direction of the pressure side and suction side walls 16 and 18.

Figure 10:
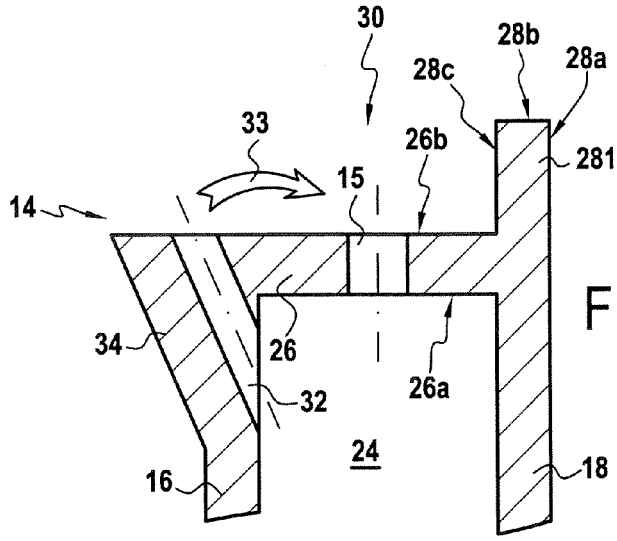
FIGS. 10 and 11 are views analogous to FIG. 5 on directions X-X and XI-XI in FIG. 9 showing the other two shapes of the end of the FIG. 9 blade.

In addition, as can be seen in FIG. 10, the middle portion between the front and the rear of the blade of FIG. 9 differs:

beside the pressure side wall 16, this middle portion is identical to the configuration of FIG. 7 or the front of the blade of FIG. 9, i.e. there is no pressure side rim and the projecting end portion 34 terminates at the height of the outside face 26*b* of the end wall 26; and beside the suction side wall, the suction side rim 281 is vertical, its outside and inside faces 28*a* and 28*c* being parallel to each other, as for the configuration of FIG. 11.

Figure 12:
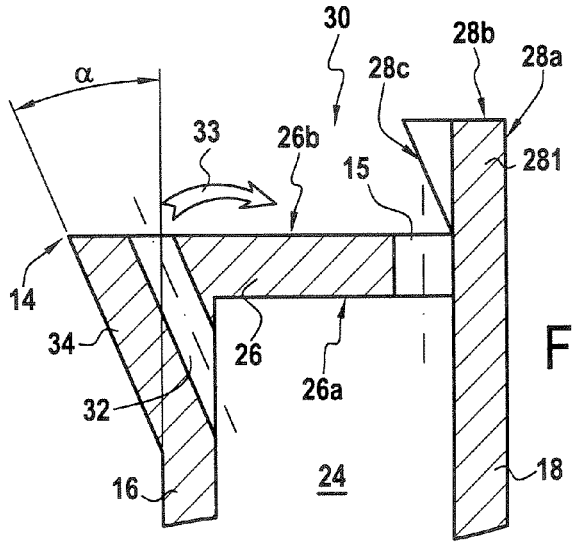
FIG. 12 shows a variant to FIG. 7 with the through holes offset under the base of the section side rim.

In a variant embodiment shown in FIG. 12, the FIG. 7 configuration is arranged differently in that the holes 15 are offset towards the suction side wall 18, opening out beneath the base of the suction side rim 281, in the inclined inside face 28*c*.

What is claimed is:

1. A hollow rotor blade for the turbine of a gas turbine engine, the blade including a pressure side wall and a suction side wall that meet each other at a leading edge and at a trailing edge, said leading and trailing edges extending between a blade root and a free end, said blade further including an internal cooling passage, an open cavity situated at the free end of the blade and defined by an end wall extending over the entire free end of the blade and by a rim extending between the leading edge and the trailing edge along at least the suction side wall, and cooling channels connecting said internal cooling passage and the free end beside the pressure side wall, said cooling channels being inclined relative to the pressure side wall, the pressure side wall presenting a projecting end portion whose outside face is inclined relative to the outside face of the pressure side wall, the end wall being connected to the pressure side wall at said end portion, and said cooling channels being disposed in said end portion, being parallel to the outside face of said end portion so that they open out into the tip of said end portion towards the free end of the blade, wherein at least a portion of the tip of the end portion lies in the same plane as the outside face of the end wall, such that at least some of said cooling channels open out into the edge of the open cavity beside the pressure side wall, and wherein at least a first portion of the inside face of said rim of the suction side wall is inclined, enlarging said rim radially towards the free end of the blade.

2. A turbine blade according to claim 1, wherein the outside face of the end wall is substantially perpendicular to the pressure side wall and to the suction side wall.

3. A turbine blade according to claim 1, wherein the outside face of the end wall is inclined relative to the pressure side wall and to the suction side wall, forming an acute angle with the rim of the cavity extending the suction side wall.

4. A turbine blade according to claim 1, wherein:

in a lead portion of the blade located downstream from the leading edge, the tip of the end portion lies in the same plane as the outside face of the end wall, and the inside face of said rim of the suction side wall is inclined so as to enlarge said rim; while in a trail portion of the blade located upstream from the trailing edge and downstream from said lead portion, beside the pressure side wall, projecting end portion has a pressure side rim that is enlarged radially towards the free end of the blade at its tip, and beside the suction side wall there is a second portion of the suction side rim that is not enlarged radially towards the free end of the blade at its tip.

5. A turbine blade according to claim 1, wherein through holes pass through the end wall between the internal cooling passage and the base of the rim of the suction side wall.

6. A turbine blade according to claim 1, the turbine blade being used for a high pressure turbine.

7. Turbine comprising a turbine blade according to claim 1.

8. Gas turbine comprising a turbine blade according to claim 1.

* * * * *